US006123507A

United States Patent [19]

Weis

[11] Patent Number: 6,123,507

[45] Date of Patent: Sep. 26, 2000

[54] SINGLE PORT IMPELLER

[75] Inventor: Frank G. Weis, Kansas City, Mo.

[73] Assignee: Smith & Loveless, Inc., Lenexa, Kans.

[21] Appl. No.: 09/200,616

[22] Filed: Nov. 30, 1998

[51] Int. Cl.[7] ..... F04D 29/00

[52] U.S. Cl. ..... 416/144; 416/186 R; 416/181; 416/229 R; 416/231 R; 416/223 B

[58] Field of Search ..... 416/186 R, 181, 416/183, 185, 223 B, 231 BR, 229 R, 144, 241 AB, 500, 19; 415/227, 228

[56] References Cited

U.S. PATENT DOCUMENTS

| | | | |
|---|---|---|---|
| 1,439,365 | 12/1922 | Hazell . | |
| 1,470,607 | 10/1923 | Hazell . | |
| 2,741,992 | 4/1956 | Blazebrook | 145/227 |
| 2,853,019 | 9/1958 | Thornton | 145/227 |
| 3,032,318 | 5/1962 | Lindblom . | |
| 3,732,032 | 5/1973 | Daneel | 416/144 |
| 3,971,513 | 7/1976 | Klip | 416/144 |
| 4,292,013 | 9/1981 | Singer et al. . | |
| 4,337,018 | 6/1982 | Singer et al. . | |
| 4,530,643 | 7/1985 | Carlsson . | |
| 4,575,312 | 3/1986 | Erikson . | |
| 4,793,777 | 12/1988 | Hauenstein . | |
| 4,867,633 | 9/1989 | Gravelle . | |
| 5,011,374 | 4/1991 | Miller . | |
| 5,100,295 | 3/1992 | Madden . | |
| 5,129,284 | 7/1992 | Brueckner et al. . | |

*Primary Examiner*—Edward K. Look
*Assistant Examiner*—Ninh Nguyen
*Attorney, Agent, or Firm*—Rockey, Milnamow & Katz, Ltd.

[57] ABSTRACT

A single port pump impeller includes two pump vanes diverging arcuately and radially from a suction eye to form one open expanding chamber, and includes a blocking wall for closing the remaining, opposite expanding chamber. The two vanes are contained within parallel spaced apart shrouds. The shrouds include increased wall thickness regions to dynamically balance the impeller. The blocking wall can include a small aperture for providing a small stream of liquid to flow into the otherwise closed expanding chamber to prevent cavitation at a distal end of an adjacent vane. Alternately, the otherwise blocked expanding chamber can be filled with a solid material having substantially the same weight as the fluid being pumped, e.g., water, to prevent cavitation at the outside edge of one of the adjacent vanes.

30 Claims, 7 Drawing Sheets

SINGLE PORT IMPELLER

TECHNICAL FIELD OF THE INVENTION

The invention relates to a centrifugal pump impeller for pumping liquids. Particularly, the invention relates to a single port centrifugal pump impeller and to a method for dynamically balancing the impeller for rotating in a liquid filled pump volute.

BACKGROUND OF THE INVENTION

A typical two port pump impeller includes a suction eye having two ports opening into opposing expanding chambers. The ports have smaller openings than the single, axial opening of the suction eye due to the fact that each port handles one half of the total flow. Solids which are sufficiently small to enter the suction eye axial opening may be too large to pass through either port, eventually significantly plugging the impeller. Stringy material may have one end drawn into one port and the other end drawn into the other port. Thus, the material may be draped around the base edge of an impeller vane. More stringy materials can be built up thusly and the ports can become substantially clogged. Furthermore, even if the materials impeding flow through the ports don't completely clog the impeller, these materials may cause the pump impeller to be out-of-balance, resulting in pump vibration.

To alleviate these problems, a single port centrifugal pump impeller is used for solids-handling pumps, i.e., pumps which must handle liquids with entrained solid matter. A single port impeller eliminates clogging in solid-handling pumps, particularly pumps handling stringy materials. The single radial passage through the impeller can be substantially the same size as the opening of the suction eye of the impeller, so that any object entering the pump will pass completely through the impeller without clogging. There are no impeller parts for stringy material to hang on which would restrict flow through the impeller.

One drawback of a single port centrifugal impeller is that, unless countermeasures are taken, the impeller is inherently out of dynamic balance. To compensate for this imbalance, balance weight can be added to dynamically balance the impeller. However, improper balancing can detrimentally effect efficiency. Also, the balanced impeller cannot always be trimmed easily to create new head and flow conditions without altering its dynamic balance.

U.S. Pat. No. 1,439,365 describes a single port impeller which uses a liquid filled chamber to balance the impeller. The chamber must be filled with liquid through a hole, which is then plugged.

U.S. Pat. No. 1,470,607 describes a single port impeller which incorporates small blades or vanes arranged in opposition to the single port. The small blades function to impart an additional impulse to the liquid in the pump casing and to balance the heavy metal formation surrounding the mouth of the port. These small blades allow the impeller to be trimmed, by turning the impeller in a lathe. In the turning operation, meal is also removed from the small blades or vanes, the amount being proportionate to the amount removed from the body of the impeller. This is intended to preserve the dynamic balance of the impeller. This patent also describes the impeller having a closed chamber which is filled with liquid through a hole, thereafter plugged, to balance the impeller.

The present invention recognizes that it would be advantageous to provide a single port impeller for a solids-handling pump which remains in dynamic balance even if the impeller is trimmed on a lathe, and which impeller is resistant to cavitation, and which impeller is cost effectively manufactured.

SUMMARY OF THE INVENTION

The present invention contemplates a single port impeller with an axially arranged suction eye, which is formed in the general configuration of a two port impeller, but with one port blocked off by a blocking wall at the suction eye. The impeller includes parallel shrouds which close sides of the impeller. The shrouds have thickened wall portions located at selected regions to dynamically balance the impeller. The thickened wall portions of the shrouds are not disturbed when trimming the impeller to a smaller diameter to produce smaller heads and flows, i.e., only the vanes are trimmed inside the parallel shrouds. Thus the impeller remains in dynamic balance after trimming.

The present invention overcomes balance and cavitation problems to an effective impeller design. By blocking off the one impeller port, a pocket is formed between adjacent vanes, which pocket would tend to be a cavitation site and a site for increased liquid friction. One solution to this problem is to place a small hole in the blocking wall which blocks the port at the suction eye. This small hole creates a small flow of water through the otherwise blocked-off port and the otherwise blocked-off pocket defined between adjacent vanes. This small flow of water creates a controlled flow along the backside of the leading vane which in effect, fills in the cavitation vacuum at the vane tip and allows water to move past the vane tip outwardly instead of being diverted inwardly. This outward flow eliminates the turbulence that results in vacuum-created cavitation.

According to a second solution to the cavitation problem which would be present at a vane tip of the vanes of the pocket extending from the blocked-off port, the pocket located between the impeller vanes which proceed radially from the blocked-off port is filled with a solid material that has the same overall density as the fluid being pumped, e.g., water. One such solid material can be an epoxy which is selectively filled with microspheres of glass or ceramic of the proper volume for the solid material to have an overall density equal to the density of the fluid being pumped. The solid material fill forms a solid plug which prevents the existence of a pocket between vanes which are adjacent to the blocked-off port, where cavitation can occur. The solid plug can be trimmed along with the vanes when altering the size of the impeller for smaller flows and heads. The smooth outer contour of the solid plug also acts to increase the efficiency of the impeller by decreasing the fluid friction which would otherwise be present by the existence of the pocket between the vanes.

Unlike some known single port impellers, the present invention single port impeller is a simpler design and does not require a water filled chamber to dynamically balance the impeller. The impeller can be trimmed to a range of sizes without effecting the impeller balance. The impeller is resistant to cavitation otherwise caused by the blocked-off port.

Numerous other advantages and features of the present invention will; become readily apparent from the following detailed description of the invention and the embodiments thereof, from the claims and from the accompanying drawings.

DETAILED DESCRIPTION OF THE PREFERRED EMBODIMENTS

Figure 1:
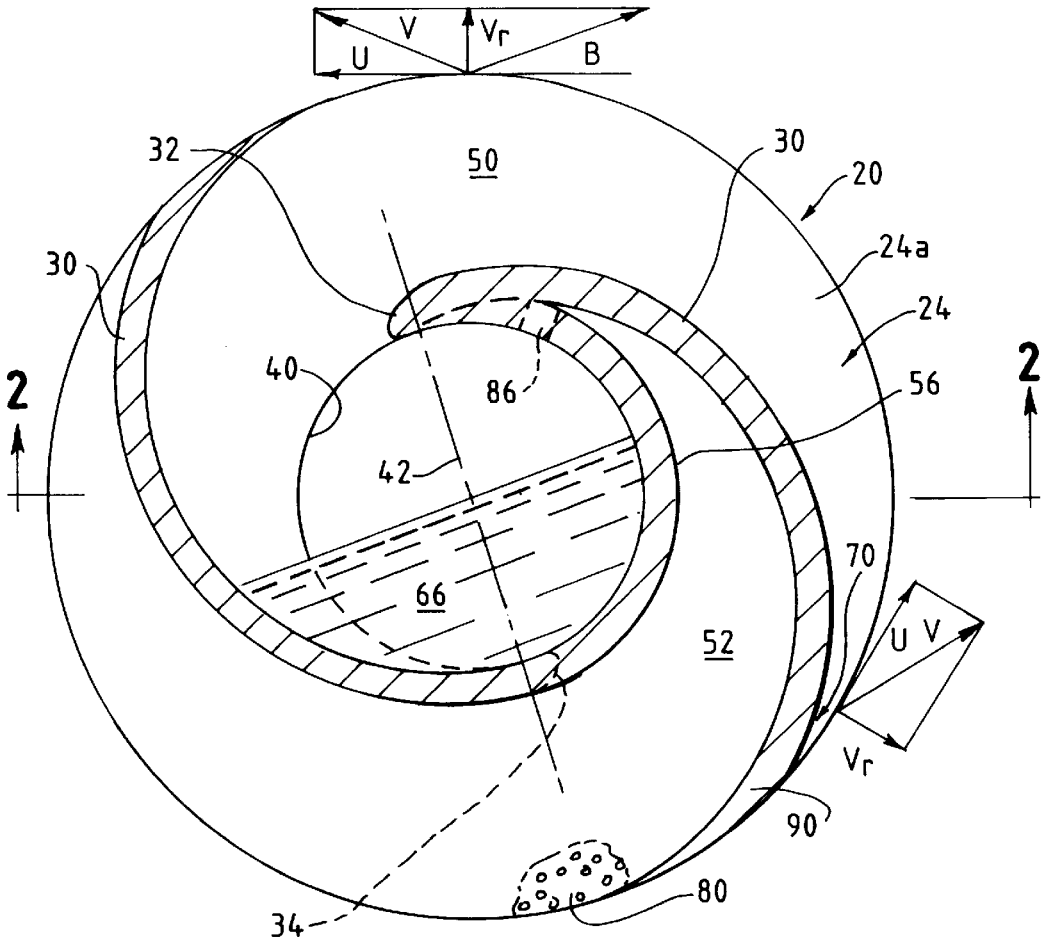
FIG. 1 is a schematic bottom view of a single port impeller of the present invention with a bottom shroud removed for clarity.

While this invention is susceptible of embodiment in many different forms, there are shown in the drawings, and will be described herein in detail specific embodiments thereof with the understanding that the present disclosure is to be considered as an exemplification of the principles of the invention and is not intended to limit the invention to the specific embodiments illustrated.

Figure 13:
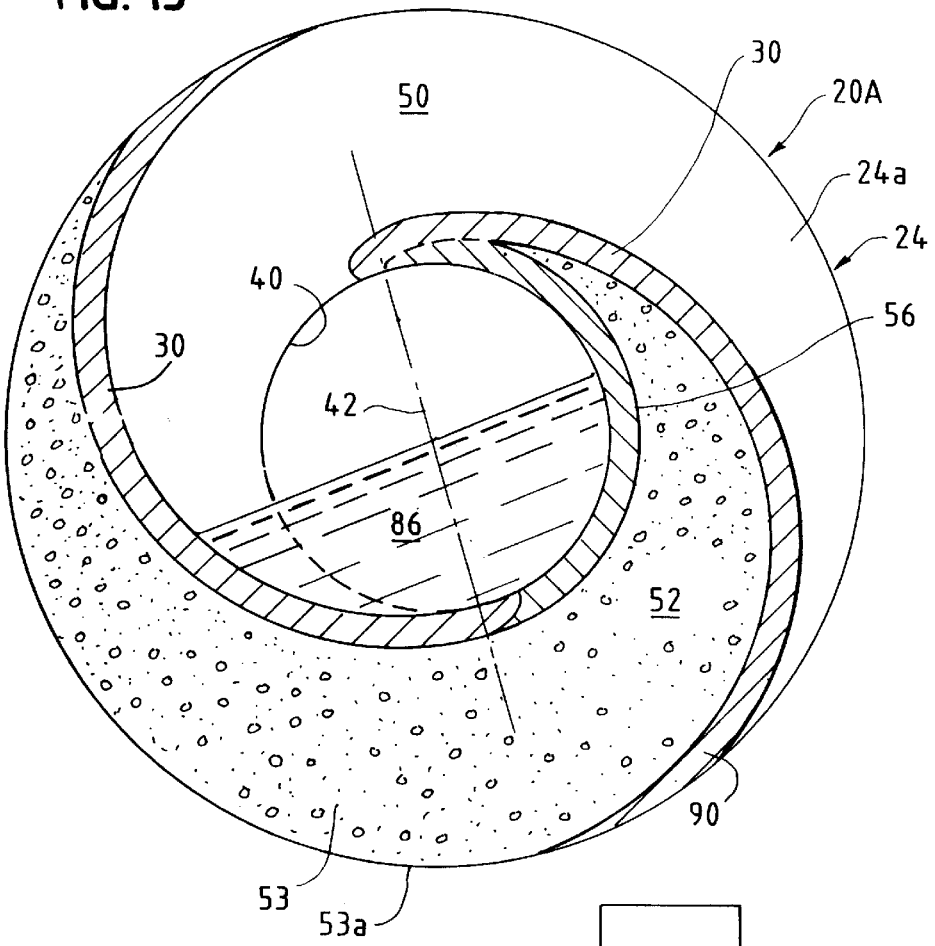
FIG. 13 is a schematic bottom view of a single port impeller of the present invention with a bottom shroud removed for clarity.
Figure 14:
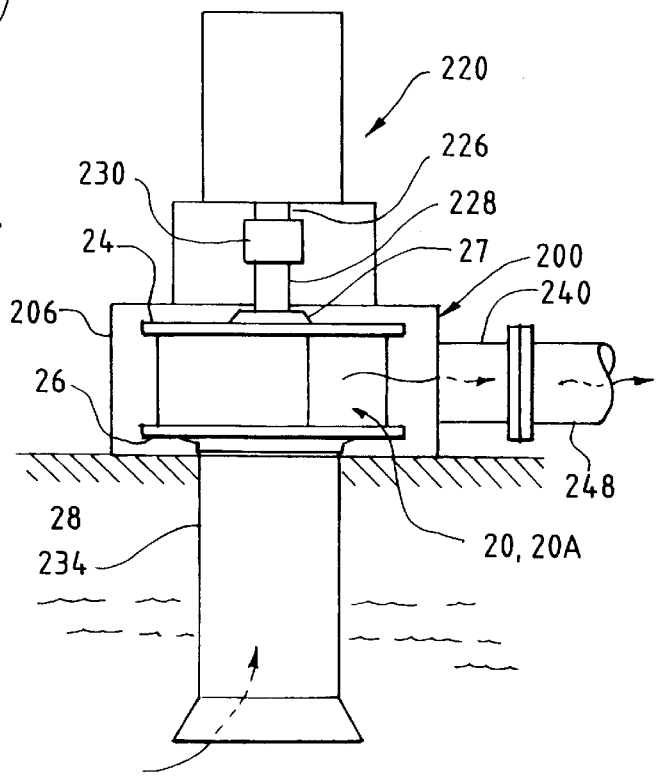
FIG. 14 is a schematic elevational view of a pump incorporating the impeller of the present invention.

For purposes of clarity in describing the pump impeller of the present invention, the views shown in FIGS. 2, 4–10, and 13 depict the pump impeller upside down to its normal operating orientation as depicted in FIG. 14.

FIG. 1 is a schematic view of an impeller 20 of the present invention. The impeller includes a first shroud 24 (top shroud) and a second shroud 26 (bottom shroud, shown in FIG. 2). The shrouds 24, 26 include annular plate members 24*a*, 26*a* respectively arranged in parallel and spaced apart. The first shroud 24 also includes a hub 27 having a hub center hole 27*a* for receiving a driven shaft (shown in FIG. 14). The hub 27 is formed unitarily with the annular plate member 24*a*. The second shroud 26 also includes a neck 28 having an axial bore 29. The neck 28 is formed unitarily with the annular plate member 26*a*. Two arcuate blades or banes 30 are arranged between the shrouds 24, 26. The vanes 30 have base ends 32, 34 respectively which extend from position which are approximately diametrically opposed across a suction eye 40, particularly, across a centerline 42 thereof. The suction eye 40 is a substantially cylindrical or frustoconical space arranged between the shrouds 24, 26 and open to the bore 29.

The vanes 30 create two expanding chambers 50, 52. The expanding chamber 52 is blocked off from the suction eye 40 by a suction eye blocking wall 56. Thus, substantially all of the flow which is received into the suction eye 40 from the bore 29 must pass out of the impeller through the expanding chamber 50. Since the expanding chamber 50 has a lateral clearance through its defined flow path which is substantially equal to the diameter of the suction eye, and substantially equal to the diameter of the bore 29, clogging of the impeller is prevented as all material small enough to fit through the bore 29 will pass through the expanding chamber 50.

To compensate for the eccentric weight of the material of the blocking wall 56, the first and second shroud plate members 24*a*, 26*a* each have an incremental or increased wall thickness region 60, 61 respectively, as described below. The added weight of the wall thickness regions 60, 61 is spread out over a large thin area so that it does not adversely effect pump efficiency. The annular plate members 24*a*, 26*a* thus have first annular portions 24*b*, 26*b* which are concentrically balanced about their center axes and second portions, the increased wall thickness regions 60, 61, which are eccentrically located with respect to the center axes and are used to counterbalance, in part, the eccentrically located mass of the blocking wall 56. Additionally, the centrifugal force of water 66 in a blocked-off "cup" of the suction eye 40 is also balanced by the mass of the regions 60, 61. The annular portions 24*b*, 26*b* are formed unitarily with the thickness regions 60, 61 respectively. For clarity, the increased thickness regions 60, 61 are shown with different cross hatching than the annular portions 24*b*, 26*b*.

The water thrust from the periphery of the impeller is at different angles for low flow and high flow. The balance weight in the regions 60, 61 must be widely dispersed to balance over the flow range. The weight of the water 66 in the blocked-off cup can be utilized to balance part of the thrust by lessening the balance weight in the regions 60, 61.

The thrust is opposite to a velocity vector V shown in FIG. 1. U is the peripheral velocity, Vr is the radial velocity and V is the vector sum of the two components. In FIG. 1, the opposite reaction to V would only hit a vane 30 at the extreme end 70. As radial velocity increases, the resultant velocity V would become more radial to the center of the impeller and the thrust presses against more of the vane, causing greater dynamic unbalance. The impeller must be designed to keep the radial velocity low enough that the reaction thrust from vector V never hits a vane, or at most hits very little of a vane as shown in FIG. 1.

As can be seen in FIG. 1, the water 66 in the blocked-off cut is located on opposite sides of the centerline 42 and can be a balance weight for all or part of the suction eye blocking wall 56. A successful, dynamically balanced impeller relies on a very scientific means of balancing all of the variables. Even so, a means of actually testing and precisely determining the final balance which is not completely achieved in the scientific balance is required. This must be done under actual operation at various flows and heads.

Figure 2:
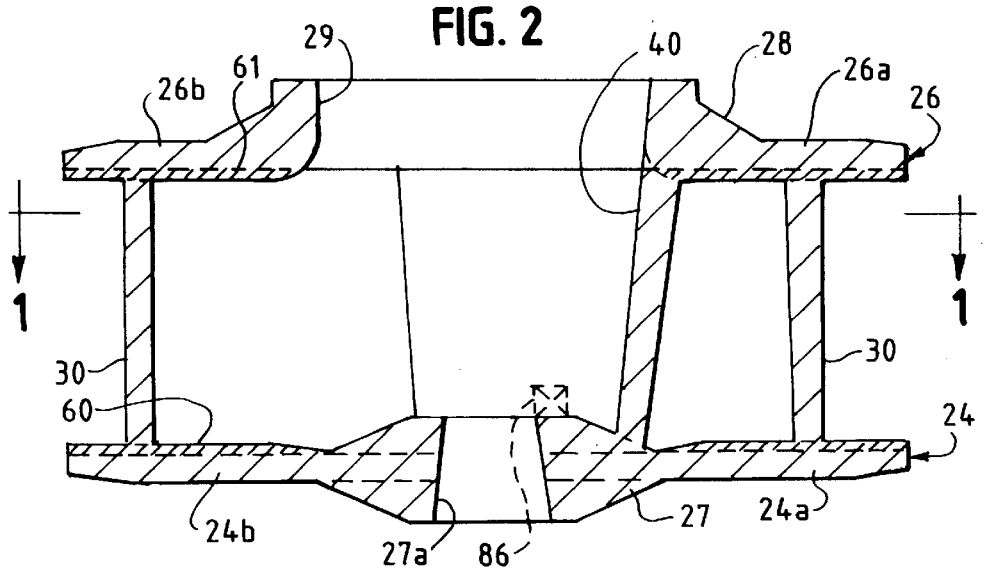
FIG. 2 is a sectional view taken generally along line 2—2 from FIG. 1.

The final increase in wall thickness in the regions 60, 61 incorporated into the shrouds 24, 26 must be relatively small so as not to affect flow through the pump. The regions 60, 61 in FIGS. 1 and 2 are not disturbed when trimming the impeller to a desired diameter to produce smaller heads and flows. Only the vanes 30 are trimmed between the first and second shrouds 24, 26. The vanes being in dynamic balance, remain in dynamic balance when they are trimmed to a smaller diameter. The extra metal of the increased thickness regions 60, 61 in the first and second shrouds 24, 26 remains constant during trimming, to perform the desired balancing function.

When the impeller operates, cavitation, indicated at 80 in FIG. 1, can occur behind the tip of one of the vanes 30. This cavitation is the result of the suction eye blocking wall 56 blocking flow through the expanding chamber 52. The high velocity flow past the vane tip reduces the pressure below the vapor pressure of the fluid in this passage. The water at this point turns to vapor. The downstream collapse of the vapor bubbles causes extreme noise, blade deterioration, and some vibration.

According to the invention, this phenomena can be alleviated by either of two methods.

One method to prevent cavitation is to place a small hole 86 through the suction eye blocking wall 56. This small hole 86 creates a small flow of water through the expanding chamber 52 as shown in FIG. 1. This small flow creates a control input along the backside 90 of the leading blade 30. This flow fills in the vacuum 80 at the vane tip and lets the fluid moving past the vane tip move outward instead of being diverted inward. The outward flow suppresses the turbulence and the resultant vacuum-created cavitation.

FIGS. 3 through 7 illustrate a preferred embodiment structure for the impeller 20 shown in FIG. 1. The impeller shown is a 4" diameter suction eye, 10" impeller diameter, 3" high vane, impeller. The vanes 30 define the arcuate expanding chambers 50, 52. The vanes 30 each have a radially inwardly sloping face 30*a*. The blocking wall 56 blends into the base ends 32, 34 of the vanes 30. The small hole 86 is typically a 1"×1" square hole. The hub center hole 27*a* includes a key way 102 for locking a driven shaft 228 therein for turning the impeller, as shown in FIG. 14. The suction eye 40 is partly defined by a declined wall 40*a* extending downward to the shaft-receiving, center hub hole 27*a*.

Figure 3:
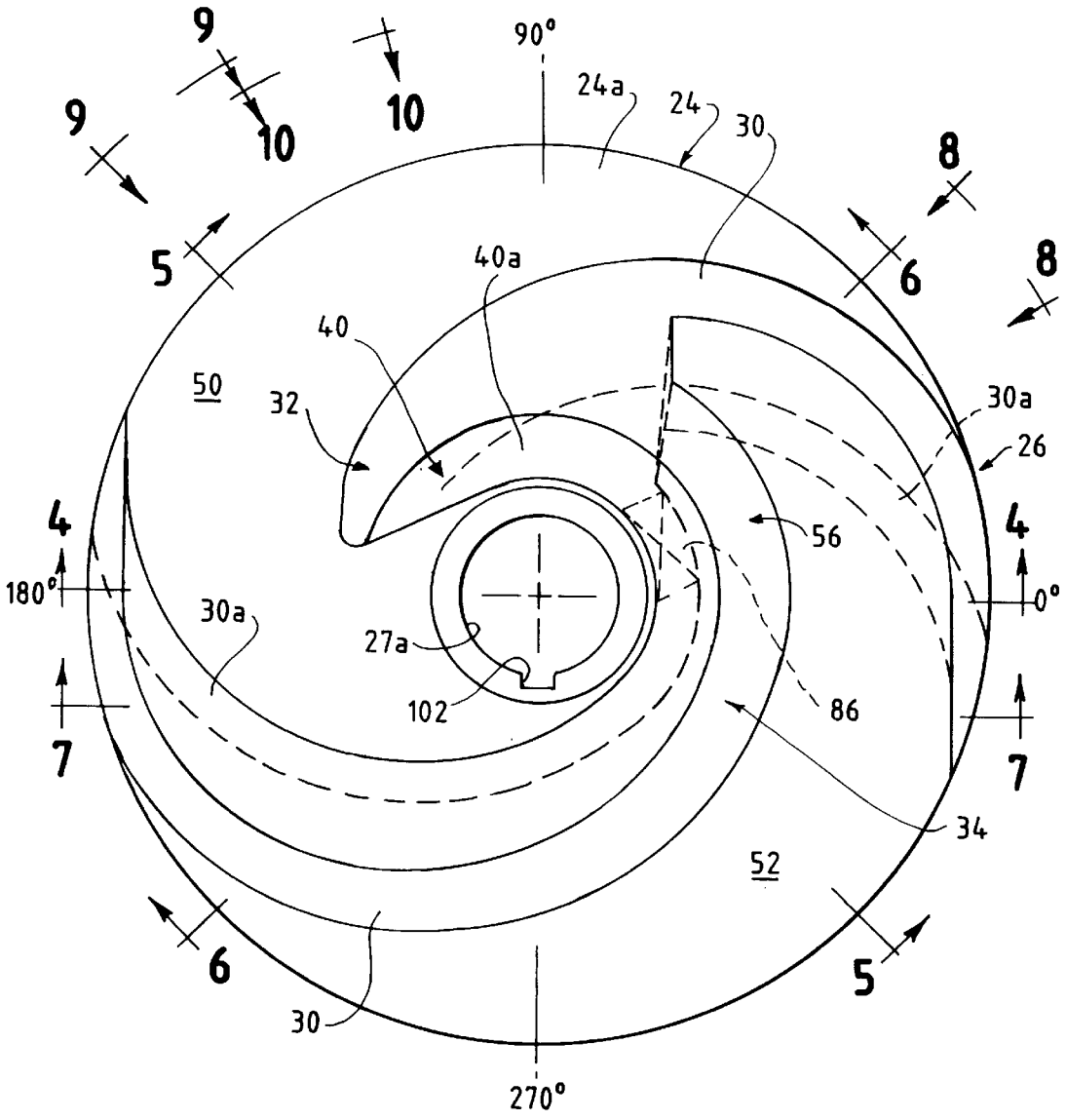
FIG. 3 is a bottom view of a preferred embodiment single port impeller with a bottom shroud removed for clarity.
Figure 4:
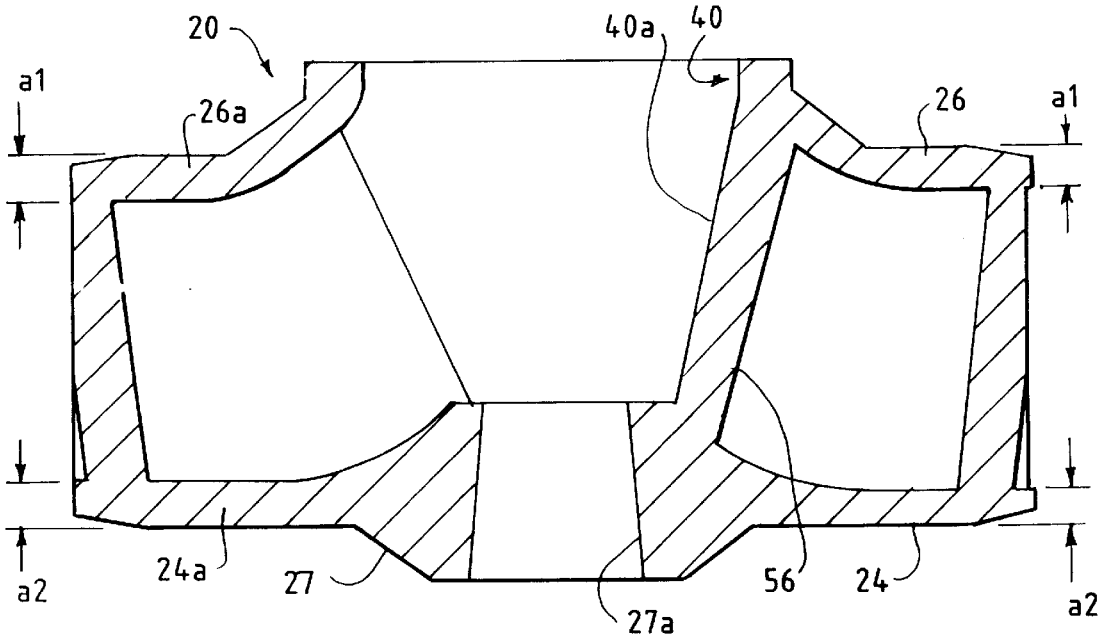
FIG. 4 is a sectional view taken generally along line 4—4 of FIG. 3.
Figure 5:
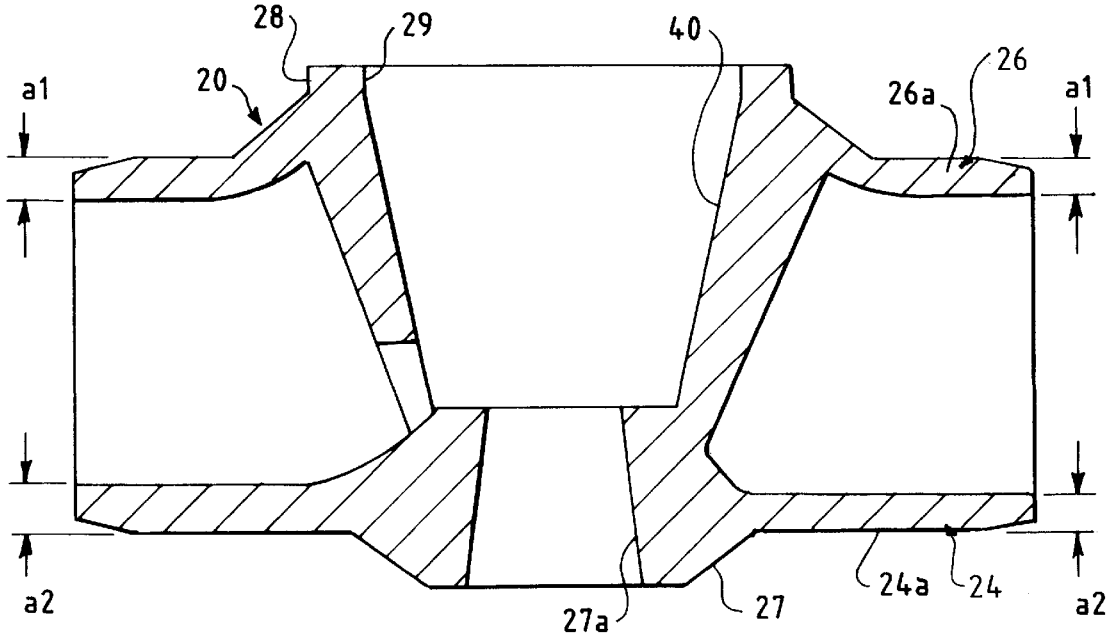
FIG. 5 is a sectional view taken generally along line 5—5 of FIG. 3.
Figure 6:
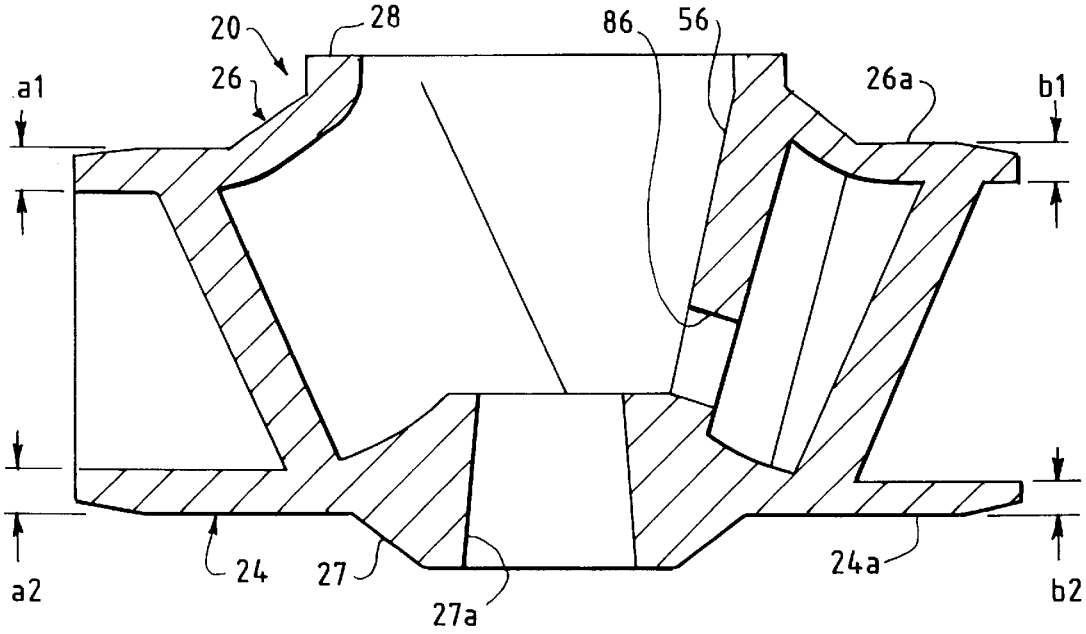
FIG. 6 is a sectional view taken generally along line 6—6 of FIG. 3.
Figure 7:
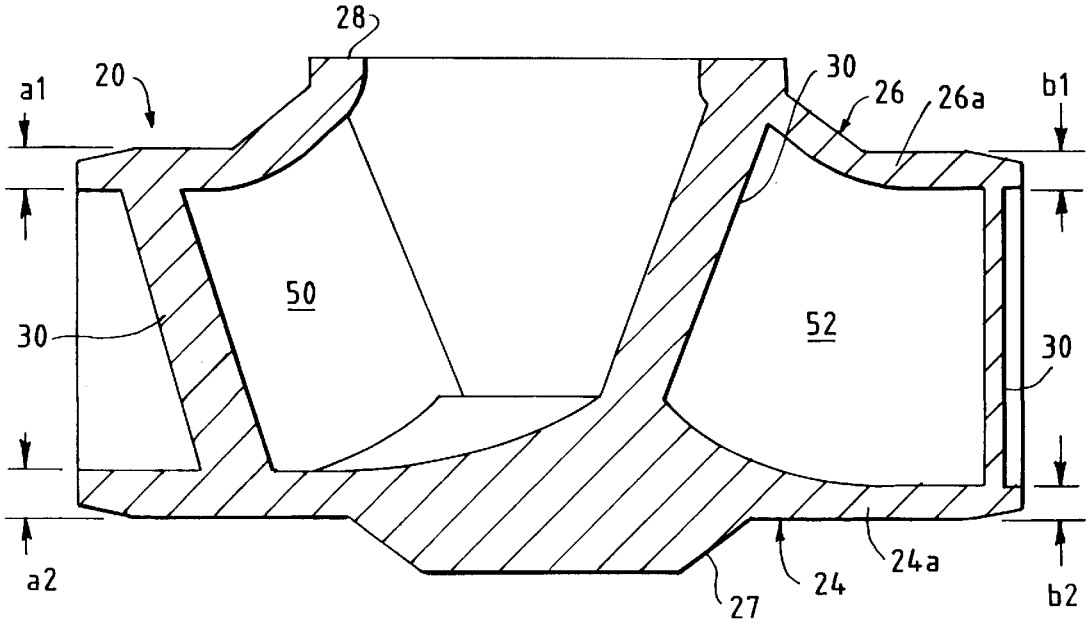
FIG. 7 is a sectional view taken generally along line 7—7 of FIG. 3.
Figure 8:
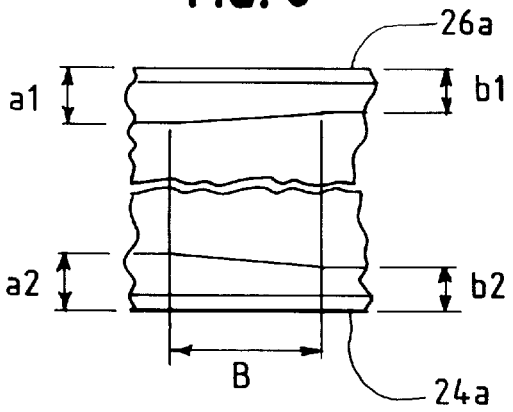
FIG. 8 is a view taken generally along line 8—8 of FIG. 3.

FIG. 8 illustrates a view taken along line 8—8 in FIG. 3. This view shows the shroud plate members 24*a*, 26*a* becoming thicker moving in a clockwise direction in FIG. 3. The first and second shroud plate member thicknesses increase from a thickness b1, b2 to a1, a2 respectively across an angle B described in FIGS. 11 and 12.

Figure 9:
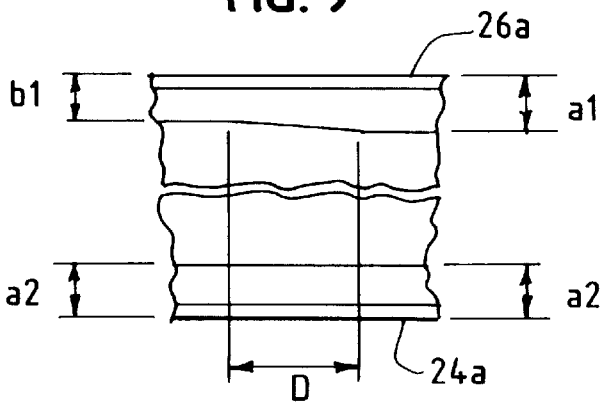
FIG. 9 is a view taken generally along line 9—9 of FIG. 3.
Figure 11:
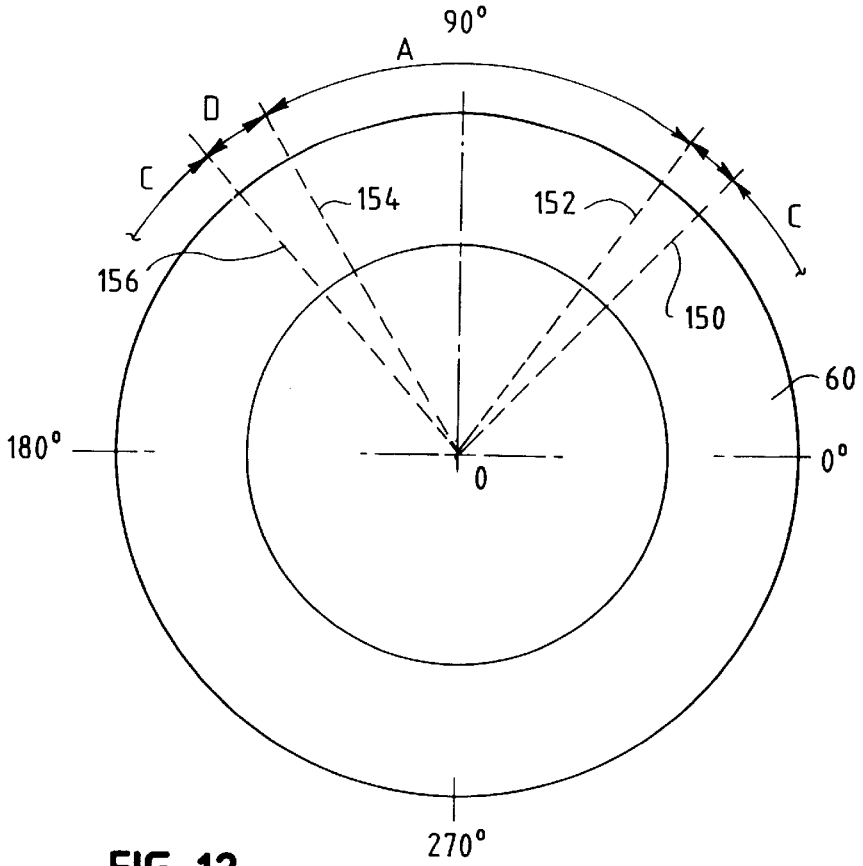
FIG. 11 is a simplified schematical plan view of a bottom shroud plate member of the present invention.

FIG. 9 illustrates that along view 9—9 in FIG. 3, thickness of the shroud plate member 26*a* is decreased from a1 to b1 moving in a clockwise direction across an angle D as described in FIG. 11.

Figure 10:
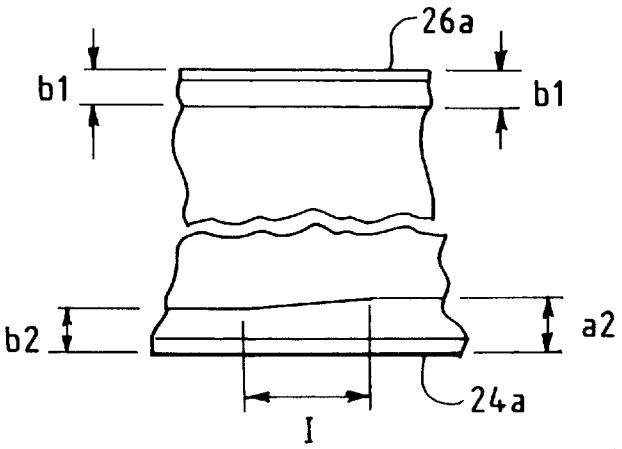
FIG. 10 is a view taken generally along line 10—10 of FIG. 3.
Figure 12:
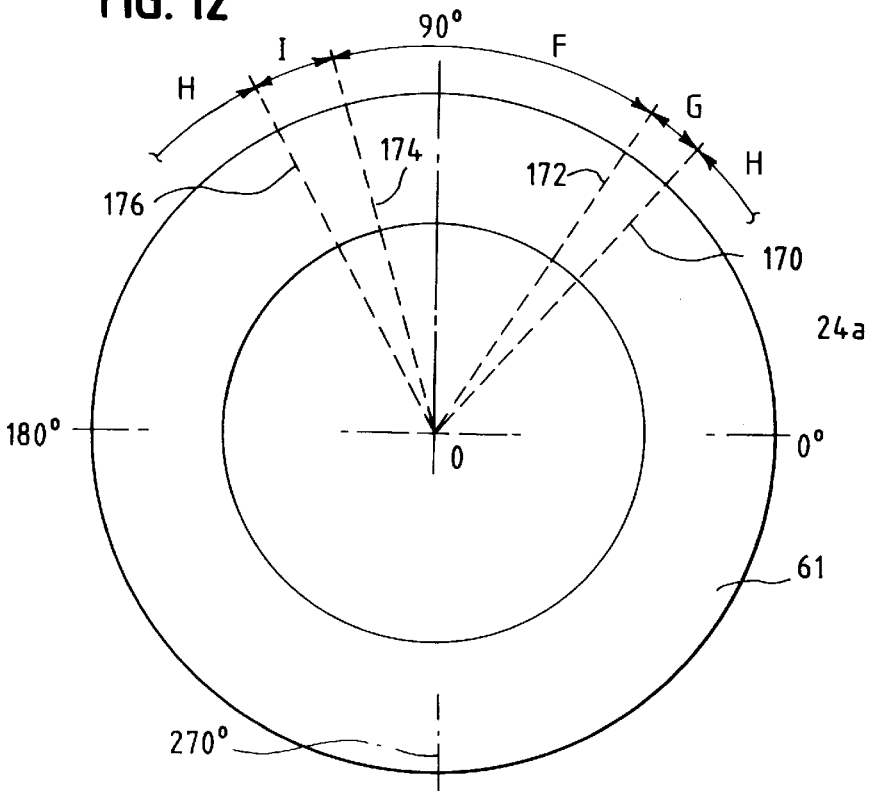
FIG. 12 is a simplified schematical plan view of a top shroud plate member of the present invention.

FIG. 10 illustrates that along view 10—10, thickness of the shroud plate member 24*a* is decreased from a2 to b2 moving in a clockwise direction across an angle I as described in FIG. 12.

FIG. 11 illustrates the second (bottom) shroud plate member 26*a* arranged at the same rotary orientation and on the same coordinate system shown in FIG. 3. A first angular position 150 is arranged at about 45°. From this position 150 moving counterclockwise to the angular position 152 defines an angle B. Within the angle B, moving counterclockwise along the circumference of the plate member 26*a*, the thickness of the shroud plate member 26*a* decreases linearly from a1 to b1. The angle B is preferably about 15°. Moving counterclockwise to the angular position 154 defines an angle A. The position 154 is preferably at about 120° and the angle A is about 60°. Within the angle A the shroud plate member 26*a* has a thickness b1. Moving further counterclockwise to the angular position 156 defines an angle D. The position 156 is preferably at about 135° and the angle D spans about 15°. Within the angle D moving counterclockwise along the circumference of the plate member 26*a*, the shroud plate member thickness linearly increases from b1 to a1. Moving further counterclockwise to the initial angular position 150 defines the reflex angle C. The angle C spans about 270°. Within the angle C the shroud plate 26*a* has a thickness of a1. Preferably the thickness a1 is about 15/32 inches and b1 is about 3/8", for a 4" diameter suction eye, single port impeller, having an outer diameter of approximately 10 1/8", and a vane height of about 3".

FIG. 12 illustrates the first (top) shroud plate member 24*a* arranged at the same rotary orientation and on the same coordinate system shown in FIG. 3. A first angular position 170 is arranged at about 45°. From this position 170 counterclockwise to the angular position 172 defines an angle G. Within the angle G moving counterclockwise along the circumference of the plate member 24*a*, the thickness of the shroud plate member 24*a* decreases linearly form a2 to b2. The angle G is preferably about 15°. Moving counterclockwise to the angular position 174 defines an angle F. The position 174 is preferably about 105° and the angle F is preferably about 45°. Within the angle F the shroud plate member 24*a* has a thickness b2. Moving further counterclockwise to the angular position 176 defines an angle I. The position 176 is preferably at about 120°, and the angle I spans about 15°. Within the angle I, moving counterclockwise along the circumference of the plate member 24*a*, the shroud thickness increases linearly from b2 to a2. Moving further counterclockwise to the initial angular position 170 defines the reflex angle H. Within the angle H the shroud plate member 24*a* has a thickness of a2. The angle H spans about 285°. Preferably the thickness a2 is about 18/32" and b2 is about 3/8", for the 4" diameter suction eye single port impeller having an outer diameter approximately 10 1/8", and a vane height about 3".

Another method to alleviate cavitation and balance problems is shown in FIG. 13, embodied as alternate impeller 20A. In this method, the cavity of expanding chamber 52 is filled with a solid material that has the same overall density as the pumped fluid. One such material can be an epoxy precisely filled with microspheres of glass or ceramic material of the proper amount to create an overall density equal to the density of the liquid being pumped, e.g., water. This fill forms a crescent shaped solid plug 53 that prevents a pocket otherwise formed by the expanding chamber 52. The solid plug also presents a smooth outer circumferential surface 53*a* which increases the efficiency of the impeller by preventing fluid from entering the pocket otherwise formed by the blocking wall 56 and the vanes 30. The solid plug 53 can be trimmed along with the vanes 30 is a different head or flow rate is desired.

FIG. 14 illustrates schematically a pump 200 using the impeller 20 or 20A described in FIGS. 1 and 13 respectively. The pump 200 includes a casing 206, typically in a volute shape, which surrounds the impeller 20, 20A. In typical operation, the first shroud 24 is located above the second shroud 26. The pump 200 is driven by a motor 220. The motor 220 includes a drive shaft 226 connected to a driven shaft 228 by a coupling 230. The driven shaft 228 penetrates the casing 206 and is press fit into the hub 27, particularly into the hub hole 27*a*. The neck 28 is in flow communication, through the casing 206, with a suction pipe 234 which takes suction from below. The volute shaped casing includes an outlet 240 which is connected to an outlet pipe 248.

The present invention provides a single port pump impeller and a pump which is resistant to clogging, cavitation and vibration. The pump impeller is cost effectively manufactured and assembled and can be trimmed easily for revising flow and pressure head characteristics without substantially altering its balance.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An impeller for a pump, comprising:

a suction inlet passage, the suction inlet passage having an axis aligned with an axis of rotation of said impeller; and a first vane and a second vane each extending from said inlet passage from base ends which are spaced apart and which diverge to distal ends, said first and second vanes forming first and second expanding chambers, said inlet being open to said first expanding chamber between said base ends of said vanes, and closed to said second expanding chamber by a blocking wall between said base ends; and at least one shroud extending substantially perpendicularly to said axis of said inlet passage, said shroud overlying said first and second expanding chambers, aid shroud having a first portion being in dynamic balance about said axis of said inlet passage and a second portion arranged eccentrically of said axis to dynamically balance at least a portion of an eccentric weight of said blocking wall.

2. The impeller according to claim 1, wherein said at least one shroud includes two shrouds arranged in parallel and spaced apart by a distance equivalent to a width of said first and second vanes, and said second portion comprises an increased wall thickness applied within regions of said two shrouds.

3. An impeller for a pump comprising:

a suction inlet passage, the suction inlet passage having an axis aligned with an axis of rotation of said impeller; and a first vane and a second vane each extending from said inlet passage from base ends which are spaced apart and which diverge to distal ends, said first and second vanes forming first and second expanding chambers, said inlet being open to said first expanding chamber between said base ends of said vanes, and closed to said second expanding chamber by a blocking wall between said base ends;

at least one shroud extending substantially perpendicularly to said axis of said inlet passage, said shroud having a first portion being in dynamic balance about said axis of said inlet passage and a second portion arranged eccentrically of said axis to dynamically balance at least a portion of an eccentric weight of said blocking wall; and wherein said blocking wall includes a hole therethrough for passing a reduced amount of liquid through said second expanding chamber, said amount less than a relatively larger amount passing through said first expanding chamber.

4. An impeller for a pump, comprising:

a suction inlet passage, the suction inlet passage having an axis aligned with an axis of rotation of said impeller; and a first vane and a second vane each extending from said inlet passage from base ends which are spaced apart and which diverge to distal ends, said first and second vanes forming first and second expanding chambers, said inlet being open to said first expanding chamber between said base ends of said vanes, and closed to said second expanding chamber by a blocking wall between said base ends;

at least one shroud extending substantially perpendicularly to said axis of said inlet passage, said shroud having a first portion being in dynamic balance about said axis of said inlet passage and a second portion arranged eccentrically of said axis to dynamically balance at least a portion of an eccentric weight of said blocking wall; and a solid material fill located in said second expanding chamber forming a solid plug, said fill having an overall density equivalent to a fluid being pumped by said impeller.

5. The impeller according to claim 4, wherein said solid material comprises an epoxy filled with microspheres.

6. The impeller according to claim 5, wherein said microspheres are composed of at least one of: ceramic material and glass material.

7. The impeller according to claim 1, wherein said second portion is distributed on said shroud such that said impeller can be trimmed without altering the dynamic balance of the second portion and said portion of said blocking wall.

8. The impeller according to claim 1, wherein said second portion comprises an increased wall thickness region of said shroud, said increased wall thickness region having a truncated circular sector shape.

9. The impeller according to claim 1, said at least one shroud includes two shrouds arranged in parallel and spaced apart by a distance equivalent to a width of said first and second vanes, and said second portion comprises increased wall thickness regions of said two shrouds, said increased wall thickness regions each having a truncated circular sector shape.

10. The impeller according to claim 9, wherein said increased wall regions of said shrouds are rotationally offset from each other.

11. The impeller according to claim 9, wherein said increased thickness region of each of said shrouds extends around an arc of between about 300 and 315 degrees.

12. A pump for pumping liquids having solid components therein, said pump comprising:

a pump casing having an inlet and an outlet; and a pump impeller rotatably driven within said pump casing the having a suction inlet in fluid communication with said casing inlet and a first expanding chamber in fluid communication with said casing outlet, and a second expanding chamber blocked at said suction inlet by a blocking wall, and first and second shrouds arranged in parallel and spaced apart, on opposite axial sides of said first and second expanding chambers, and a balance weight carried by at least one of said shrouds to dynamically balance an eccentric weight of said blocking wall.

13. The pump according to claim 12, wherein each of said expanding chambers is defined by two vanes extending radially and arcuately from said suction inlet, said first expanding chamber having a narrow base end in fluid communication with said suction inlet and a wide discharge end in fluid communication with said casing outlet.

14. The pump according to claim 13, wherein said balance weight comprises excess metal formed into said shrouds, eccentrically about an axis of rotation of the impeller.

15. A pump for pumping liquids having solid components therein, said pump comprising:

a pump casing having an inlet and an outlet; and a pump impeller rotatably driven within said pump casing and having a suction inlet in fluid communication with said casing inlet and a first expanding chamber in fluid communication with said casing outlet, and a second expanding chamber blocked at said suction inlet by a blocking wall, and first and second shrouds arranged in parallel and spaced apart, on opposite axial sides of said first and second expanding chambers, and a balance weight carried by at least one of said shrouds to dynamically balance an eccentric weight of said blocking wall;

wherein each of said expanding chambers is defined by two vanes extending radially and arcuately from said suction inlet, said first expanding chamber having a narrow base end in fluid communication with said shrouds to dynamically balance an eccentric weight of said blocking wall;

wherein each of said expanding chambers is defined by two vanes extending radially and arcuately from said suction inlet, said first expanding chamber having a narrow base end in fluid communication with said suction inlet and a wide discharge end in fluid communication with said casing outlet; and wherein said blocking wall further includes an aperture for allowing a reduced flow rate of fluid to pass into said second expanding chamber compared to a flow rate of fluid passing through said first expanding chamber.

16. A pump for pumping liquids having solid components therein, said pump comprising:

a pump casing having an inlet and an outlet;

a pump impeller rotatably driven within said pump casing and having a suction inlet in fluid communication with said casing inlet and a first expanding chamber in fluid communication with said casing outlet, and a second expanding chamber blocked at said suction inlet by a blocking wall, and first and second shrouds arranged in parallel and spaced apart, on opposite axial sides of said first and second expanding chambers, and a balance weight carried by at least one of said shrouds to dynamically balance an eccentric weight of said blocking wall;

wherein each of said expanding chambers is defined by two vanes extending radially and arcuately from said suction inlet, said first expanding chamber having a narrow base end in fluid communication with said suction inlet and a wide discharge end in fluid communication with said casing outlet; and wherein a space defined by said vanes which is within said second expanding chamber is at least partially filled with a solid material to dynamically balance liquid held within said first expanding chamber.

17. The pump according to claim 13, wherein inside regions of said two shrouds include flat thickened portions for dynamically balancing the weight of said blocking wall.

18. The pump according to claim 17, wherein one of said shrouds is integrally formed with said suction inlet, and the respective other of said shrouds includes a drive-shaft-receiving hole.

19. An impeller for a pump, comprising:

a suction inlet passage, the suction inlet passage having an axis aligned with an axis of rotation of said impeller; and a first vane and a second vane each extending from said inlet passage from base ends which are spaced apart and which diverge to distal ends, said first and second vanes forming two first and second expanding chambers, said inlet being open to said first expanding chamber between said base ends of said vanes, and substantially closed to said second expanding chamber by a blocking wall between said base ends; and at least one opening through said blocking wall to allow a reduced flow of fluid through said second expanding chamber compared to the flow of fluid through said first expanding chamber.

20. The impeller according to claim 19, wherein said impeller includes two shrouds extending substantially perpendicularly to said axis of said inlet passage, said shrouds having first portions being in dynamic balance about said axis of said inlet passage and second portions arranged eccentrically of said axis to dynamically balance at least a portion of an eccentric weight of said blocking wall, said two shrouds arranged in parallel and spaced apart by a distance equivalent to a width of said first and second vanes, and said second portion comprises increased wall thickness applied within regions of said two shrouds.

21. An impeller for a pump, comprising:

a suction inlet passage, the suction inlet passage having an axis aligned with an axis of rotation of said impeller; and a first vane and a second vane each extending from said inlet passage from base ends which are spaced apart and which diverge to distal ends, said first and second vanes forming two first and second expanding chamber, said inlet being open to said first expanding chamber between said base ends of said vanes, and substantially closed to said second expanding chamber by a blocking wall between said base ends; and a solid material fill located in said second expanding chamber forming a solid plug, said fill having an overall density equivalent to a fluid being pumped by said impeller.

22. The impeller according to claim 21, wherein said solid material comprises an epoxy filled with microspheres.

23. The impeller according to claim 22, wherein said microspheres are composed of at least one of: ceramic material and glass material.

24. A pump for pumping liquids having solid components therein, said pump comprising:

a pump casing having an inlet and an outlet; and a pump impeller rotatably driven within said pump casing and having a suction inlet in fluid communication with said casing inlet and a first expanding chamber in fluid communication with said casing outlet, and a second expanding chamber blocked at said suction inlet by a blocking wall, at least one opening through said blocking wall to allow a reduced flow of fluid through said second expanding chamber compared to the flow of fluid through said first expanding chamber.

25. The pump according to claim 24, wherein each of said expanding chambers is defined by two vanes extending radially and arcuately from said suction inlet, said first expanding chamber having a narrow base end in fluid communication with said suction inlet and wide discharge end in fluid communication with said casing outlet.

26. The pump according to claim 24, wherein said impeller includes two shrouds extending substantially perpendicularly to said axis of said inlet passage, said shrouds having first portions being in dynamic balance about said axis of said inlet passage and second portions arranged eccentrically of said axis to dynamically balance at least a portion of an eccentric weight of said blocking wall, said two shrouds arranged in parallel and spaced apart by a distance equivalent to a height of said first and second vanes, and said second portion comprises increased wall thickness applied within regions of said two shrouds.

27. A pump for pumping liquids having solid components therein, said pump comprising:

a pump casing having an inlet and an outlet; and a pump impeller rotatably driven within said pump casing and having a suction inlet in fluid communication with said casing inlet and a first expanding chamber in fluid communication with said casing outlet, and a second expanding chamber blocked at said suction inlet by a blocking wall, wherein a space defined by said vanes which is within said second expanding chamber is at least partially filled with a solid material to dynamically balance liquid held within said first expanding chamber.

28. The pump according to claim 27, wherein said solid material comprises an epoxy filled with microspheres.

29. The pump according to claim 28, wherein said microspheres are composed of at least one of: ceramic material and glass material.

30. The pump according to claim 29, wherein said impeller includes two shrouds extending substantially perpendicularly to said axis of said inlet passage, said shrouds having first portions being in dynamic balance about said axis of said inlet passage and second portions arranged eccentrically of said axis to dynamically balance at least a portion of an eccentric weight of said blocking wall, said two shrouds arranged in parallel and spaced apart by a distance equivalent to a height of said first and second vanes, and said second portion comprises increased wall thickness applied within regions of said two shrouds.

* * * * *